US007104295B2

(12) United States Patent
Heikkinen et al.

(10) Patent No.: US 7,104,295 B2
(45) Date of Patent: Sep. 12, 2006

(54) TWO-STAGE TWO-STROKE LOG SPLITTING SYSTEM

(75) Inventors: Norman Heikkinen, Prentice, WI (US); David Foytik, Phillips, WI (US)

(73) Assignee: Multitek, Inc., Prentice, WI (US)

( * ) Notice: Subject to any disclaimer, the term of this patent is extended or adjusted under 35 U.S.C. 154(b) by 166 days.

(21) Appl. No.: 10/890,967

(22) Filed: Jul. 14, 2004

(65) Prior Publication Data

US 2005/0022902 A1 Feb. 3, 2005

Related U.S. Application Data

(60) Provisional application No. 60/490,423, filed on Jul. 28, 2003.

(51) Int. Cl.
*B27L 7/06* (2006.01)

(52) U.S. Cl. ..... 144/193.1; 144/195.1

(58) Field of Classification Search ..... 144/192–193.2, 144/195.1, 195.7, 195.8, 366; 254/104
See application file for complete search history.

(56) References Cited

U.S. PATENT DOCUMENTS 4,240,476 A * 12/1980 Rattray ..... 144/195.1
4,286,638 A 9/1981 Connolly et al.
4,353,401 A 10/1982 Schilling
4,371,020 A 2/1983 Barnes et al.
4,373,564 A 2/1983 Keikkinen
4,391,312 A 7/1983 Sakraida, Jr.
4,421,149 A 12/1983 Barnes et al.
4,478,263 A 10/1984 Johnston
4,782,866 A 11/1988 Valdez
4,829,865 A 5/1989 Nunnery et al.
4,830,070 A 5/1989 Nunnery et al.
4,830,071 A 5/1989 Gollahon
4,834,154 A 5/1989 Nunnery et al.
4,842,030 A 6/1989 Meyer
4,869,303 A 9/1989 Nunnery et al.
4,875,514 A 10/1989 Hollister, Jr.
4,961,452 A 10/1990 Hudson
5,022,445 A 6/1991 Holestine
5,711,357 A 1/1998 Smith
5,791,389 A 8/1998 Valdez
6,135,178 A 10/2000 Fager
6,609,545 B1 * 8/2003 Gelder ..... 144/195.8
6,640,852 B1 * 11/2003 Rogers ..... 144/195.1
6,769,464 B1 * 8/2004 Jenkin ..... 144/193.2

* cited by examiner

*Primary Examiner*—Derris H. Banks
*Assistant Examiner*—Shelley Self
(74) *Attorney, Agent, or Firm*—Tipton L. Randall

(57) ABSTRACT

A log splitting system comprises a splitter box, having top, bottom and sidewalls, and open entrance and discharge ends. A first set of cutting blades secured adjacent to the entrance end divides the entrance end into at least two, first sections. A second set of cutting blades, secured adjacent to the first set of cutting blades and opposite the entrance end, further divides each splitter box's first section into at least two, second sections. A ram assembly with a force applying surface moveable toward the splitter box's entrance end contacts a log with the first set of cutting blades. The ram member's surface has a plurality of surface portions, each sized to fit into one of the splitter box's first section, to further contact the log with the second set of cutting blades, splitting the log into at least four pieces.

27 Claims, 16 Drawing Sheets

TWO-STAGE TWO-STROKE LOG SPLITTING SYSTEM

CROSS-REFERENCE TO RELATED APPLICATIONS, IF ANY

This application claims the benefit under 35 U.S.C. §119 (e) of now abandoned provisional application Ser. No. 60/490,423, filed 28 Jul. 2003. Application Ser. No.60/490, 423 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a system for splitting log sections. More particularly, the present invention relates to a hydraulic device coupled to a splitter box device. Most particularly, the present invention relates to a two-stage hydraulic device coupled to a two-stage splitter box device for splitting log sections into small pieces suitable for firewood.

2. Background Information

It is common practice to split logs into smaller pieces to provide firewood that burns readily. This task can be done manually using a mall and to strike a wedge which splits the log, but this is labor intensive and requires physical strength and endurance. In recent years, hydraulic cylinders have been used to push a section of log against a stationary wedge to split the log section into smaller pieces. The simple wedge has been replaced by devices having multiple cutting edges to divide the log section into smaller pieces with a single stroke of the hydraulic cylinder. Although numerous variations on the cutting wedge, also termed a splitter box, have been developed, nearly all are subject to plugging and binding when attempting to split the log section into many smaller pieces in a single pass through the splitter box.

Connolly et al., in U.S. Pat. No. 4,286,638, describe a machine for cutting a log into a succession of pieces of predetermined length at a cutting station, moving the cut piece to a first splitting station, splitting the first cut piece at the first splitting station while the next piece is being cut at the cutting station, moving the next piece to a second splitting station, splitting the next piece at the second splitting station while a third piece is being cut at the cutting station, moving the third piece to the first splitting station, and splitting the third piece at the first splitting station while a fourth piece is being cut and so on. The production of split wood is thus substantially increased by the use of two splitters combined with means for moving the successively cut pieces alternately to the splitters.

In U.S. Pat. No. 4,353,401, Schilling discloses a method and apparatus for splitting a log substantially along the gram into a plurality of sector-shaped segments. The apparatus comprises at least one sector splitter ring having a plurality of blades, a support for locating the splitter ring in a log movement path, means for pushing the log axially along a log movement path, a rotating backplate for supporting one end of the log being pushed along, with the backplate adapted to tilt and allow the backplate-supported end of the log to rotate as the log is pushed through the splitter ring, and guide means adapted to retain the floating backplate in the log movement path. The process comprises forcing one end of a log axially against and through at least one splitting blade, the other end of the log being in contact with a backplate that can tilt, and permitting relative rotation between the log and the splitting blade so that a split occurring in the log from the splitting blade substantially tends to follow the gram in the log.

Barnes et al., in U.S. Pat. No. 4,371,020, describe a process for preparation of long wood strands. Long wood strands are required for the production of structural lumber products. These strands must be split, and a method of splitting logs into longitudinal-gram wood strands comprises the steps of radially splitting a log substantially along the gram of the log into a plurality of sector shaped segments, parallel splitting each of the sector shaped segments along the gram of the segments into a plurality of substantially parallel slabs, and further splitting each of the parallel slabs substantially along the gram of the slabs into a plurality of longitudinal-gram wood strands.

In U.S. Pat. No. 4,373,564, Heikkinen discloses a self-propelled and steerable wood processing system for converting a log into firewood wherein the wood processing system has a pick-up mechanism that can be advanced into a pile of logs to be cut with the pick-up mechanism rotatably mounted to permit placing a log on a log deck where it can be fed into a cutting and splitting mechanism for forming the log into firewood.

Sakraida, Jr., in U.S. Pat. No. 4,391,312, describes a log splitting head comprising a baseplate, first and second vertical cutting plates opposed and spaced from each other and mounted to and perpendicular with the baseplate, each including a cutting edge, a horizontal cutting plate mounted to and supported by the first and second cutting plates, and also including a cutting edge, and means for securing the baseplate to the main frame of a log splitting machine.

In U.S. Pat. No. 4,421,149, Barnes et al. disclose a process for making long wood strands. Long wood strands are required in structural lumber products and, in order to obtain maximum strength, should be split along the gram. A method of splitting a log into longitudinal-gram wood strands is disclosed comprising the steps of radially splitting the log substantially along the gram of the log into a plurality of sector shaped segments. Radial splitting includes pushing the log axially through at least one sector splitter ring, and further splitting the sector shaped segments substantially along the gram of the segments. The further splitting step includes feeding each of the sector shaped segments through two rows of intermeshing counter rotating discs, pulling each of the segments between the rows of discs and simultaneously splitting each of the segments into a plurality of longitudinal-gram wood strands.

Johnston, in U.S. Pat. No. 4,478,263, describes a mobile self-contained wood processing machine used for the processing of logs into specific lengths and then splitting the lengths into individual pieces suitable for use as firewood or the like. The individual pieces are retained in a unit bin until a desired quantity has been processed. Once the desired quantity is processed, the unit bin is operated to release the stored pieces to a handling cart or to packaging.

In U.S. Pat. No. 4,782,866, Valdez discloses a log splitting head, which includes a downwardly sloped top portion having a sharpened leading edge in the form of a V-shaped cutting blade. Beneath the top portion, a first row of vertical cutting blades is provided, each including a sharpened leading edge. Also included is a second row of vertical cutting blades beneath the first row of blades and structurally similar thereto. Separating the two rows of blades is a medial portion having a sharpened leading edge. The sides of the splitting head include two vertical plates having sharpened leading edges. All of these components are arranged in a specific angular configuration designed to accomplish log splitting with maximum efficiency. The entire unit is adapted for attachment to a horizontal platform and enables the splitting of logs into uniformly sized sections.

Nunnery et al., in a series of patents, including U.S. Pat. Nos. 4,829,865, 4,830,070, 4,834,154 and 4,869,303, describe a wood processor for cutting a log into a series of shorter lengths and subsequently splitting the shorter lengths into individual pieces of firewood or the like. The processor includes a carriage for receiving the log. Clamps engage the log from both sides to secure it in the carriage, which advances the log into contact with a plurality of parallel rotating saws. After the carriage is retracted, a pusher rod moves the cut log pieces along an axis onto a plurality of cradle members, one cradle supporting each log section. The cradle members are tilted to dump the log sections alternately onto opposite sides of the axis of log movement. The logs dumped from the cradles are fed to a plurality of individual hydraulically operated log splitters.

In U.S. Pat. No. 4,830,071, Gollahon discloses a wood stump splitting apparatus that includes a splitting chamber for receiving a plurality of various sized wood stumps. The splitting chamber has one wall including a splitter grid. Press is provided for pressing the wood stumps against cutting edges of the splitter grid and pushing the plurality of wood stumps through the splitter grid apertures. Press includes a plurality of longitudinal, spaced-apart pushing members, which push the stumps through grid apertures and ensure complete extrusion of wood pieces and prevent sticking of the compressed wood pieces in grid apertures.

Meyer, in U.S. Pat. No. 4,842,030, describes improvements in log splitting devices, including an improved log-lifting table having multiple attachment points and greater upward radial movement. A multiple-faceted splitting wedge is also disclosed, which has a cutting angle of less than 90 degrees and a splitting angle of greater than 90 degrees.

In U.S. Pat. No. 4,875,514, Hollister, Jr. discloses a method and an apparatus for performing the method, wherein a log of wood is split by being forced through a generally conical shaped apparatus, containing a multiplicity of uniquely shaped, spaced, interconnected, and cooperatively operative knives or splitting elements. The method involves forcing a large log of wood through the uniquely shaped knife, or splitting element, arrangement in such a manner that there is in effect a stepped splitting of the wood into relatively uniformly shaped pieces of wood suitable to be used for a variety of purposes including, but not limited to, firewood, and the like.

Hudson, in U.S. Pat. No. 4,961,452, describes a log splitting apparatus with a sensing mechanism arranged with adjustment linkages to vary the position of a cutter blade in accordance with the sensed diameter of a given log to-be-split. A sensing wheel is arranged to ride on the side of the log and is mounted on a pivotable arm, operatively connected to the cutter blade. The pivotable arm is connected to mechanical linkages, so as to automatically position a cutter assembly for producing the splitting of logs substantially in half. An optional multi-blade cutter assembly produces quartering of a log during a single log feeding operation.

U.S. Pat. No. 5,022,445 by Holestine discloses a double-acting hydraulic ram that drives a log section or block through a blade assembly to split the log section into several smaller pieces. The blade assembly is configured to minimize the force required to split the log section into several pieces without jamming. More specifically, the assembly includes a vertical blade having a splitting edge inclined rearward in the direction of movement of the block section toward the blade and horizontal wings cantilevered from the vertical blade. Each wing is swept outward and rearward from the vertical blade and has a leading edge staggered rearward from the splitting edge of the vertical blade. An exit conveyor is provided with a chain and flight members, driven solely by the reciprocating action of the ram for transporting the split pieces to a desired location.

In U.S. Pat. No. 5,284,193, Mires et al. disclose a log splitter having a first frame with a wedge fixedly attached thereto and extending outwardly therefrom. A carriage is mounted for reciprocation upon the first frame, and an abutment plate is attached to the carriage and extends outwardly therefrom in alignment with the wedge, so arranged to split a log between the abutment plate and the wedge. A hydraulic cylinder is present for reciprocating the abutment plate and carriage toward and away from the wedge, together with a second frame rotatably mounted to the first frame so that the first frame may rotate relative thereto about an axis. A hydraulic piston-and-cylinder is operably interposed between the first and second frames for rotating the first frame about its longitudinal axis. A log support cradle extends outwardly from the carriage, with rollers on the cradle to ease positioning of a log. The first frame rotates between a loading position, in which a log on the ground is gripped between the abutment plate and the wedge, and a splitting position, in which the log is split, with the log being lifted onto the splitter as the first frame rotates.

Smith, in U.S. Pat. No. 5,711,357, describes an adjustable, multi-wedge, splitting head for a log splitting apparatus equipped with a ram for axially advancing precut logs toward the splitting head in a horizontal direction. The apparatus includes a vertically oriented stationary post and a stationary triangular splitting wedge disposed between the post and the log to be split. The post holds upper and lower multiple splitting wedge assemblies, which can be slideably positioned on the post by hydraulic cylinder/piston units. The triangular splitting wedge severs a log into two pieces. The wedge assemblies then sever the initially produced two pieces into smaller pieces, the number of which corresponds to the number of blades in the assembly positioned to interact with the log.

In U.S. Pat. No. 5,791,389, Valdez discloses an apparatus and method for processing relatively large tree logs into relatively small firewood logs using two, spaced apart, cutting stations. The apparatus includes a central conveyor, a transfer station and a splitter station wherein relatively large tree logs are placed sequentially onto an entrance portion of each of the two spaced apart cutting stations and are cut into rounds, which are discharged onto the conveyor and moved to a transfer station. Each round is moved into a splitter station, wherein each round is moved over splitter blades to form firewood logs. The splitter blades are mounted in support members secured to a square frame, having spaced apart opposite sidewalls wherein the distance between each two aligned support members is greater than the distance between opposite sidewalls.

Fager, in U.S. Pat. No. 6,135,178, describes a device for splitting wood that comprises a rotatable and movable cutting device. A splitting blade is positioned on one end of the cutting device, which acts to split the wood when the cutting device is advanced in a direction toward the wood. The cutting device can be rotated to position the splitting blade with respect to the wood to facilitate the desired splitting of the wood. The cutting device is positioned on a positioning carriage, which is moved with respect to the wood that is to be split. The positioning carriage is movably positioned on a moveable carriage to further assist in positioning the splitting blade with respect to the wood to effectively and efficiently split the wood.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

SUMMARY OF THE INVENTION

The invention is directed to a splitter box assembly for use in a log segment splitting system. The assembly includes a splitter box member having a top, a bottom, and two sidewalls, an open entrance end and an open discharge end. A first set of cutting blades is secured interior the splitter box member and adjacent the open entrance end thereof. The first set of cutting blades divides the open entrance end of the splitter box member into at least two, first sections. A second set of cutting blades is also secured interior the splitter box member. The second set of cutting blades is offset from the first set of cutting blades and positioned adjacent the open discharge end of the splitter box member. The second set of cutting blades divides each splitter box member first section into at least two, second sections. Each cutting blade of the first and second sets has a cutting edge oriented toward the open entrance end of the splitter box member.

The invention also includes a log segment splitting system that comprises a splitter box assembly that includes a splitter box member having a top, a bottom, and two sidewalls, an open entrance end and an open discharge end. A first set of cutting blades is secured interior the splitter box member and adjacent the open entrance end thereof. The first set of cutting blades divides the open entrance end of the splitter box member into at least two, first sections. A second set of cutting blades is also secured interior the splitter box member. The second set of cutting blades is offset from the first set of cutting blades and positioned adjacent the open discharge end of the splitter box member. The second set of cutting blades divides each splitter box member first section into at least two, second sections. Each cutting blade of the first and second sets has a cutting edge oriented toward the open entrance end of the splitter box member.

The invention also includes a log segment splitting system that comprises a splitter box assembly that includes a splitter box member having a top, a bottom, and two sidewalls, an open entrance end and an open discharge end. A first set of cutting blades is secured interior the splitter box member and adjacent the open entrance end thereof. The first set of cutting blades divides the open entrance end of the splitter box member into at least two, first sections. A second set of cutting blades is also secured interior the splitter box member. The second sec of cutting blades is offset from the first set of cutting blades and positioned adjacent the open discharge end of the splitter box member. The second set of cutting blades divides each splitter box member first section into at least two, second sections. Each cutting blade of the first and second sets has a cutting edge oriented toward the open entrance end of the splitter box member.

A ram assembly includes a force applying surface, moveable toward the open entrance end of the splitter box member, to contact a log segment there between with the first set of cutting blades. The force applying surface of the ram member also includes a plurality of surface portions, with each surface portion sized to fit into one splitter box member first section. The surface portions move into the first sections to further contact the log segment with the second set of cutting blades, thereby splitting the log segment into at least four pieces.

DESCRIPTION OF THE EMBODIMENTS

Figure 1:
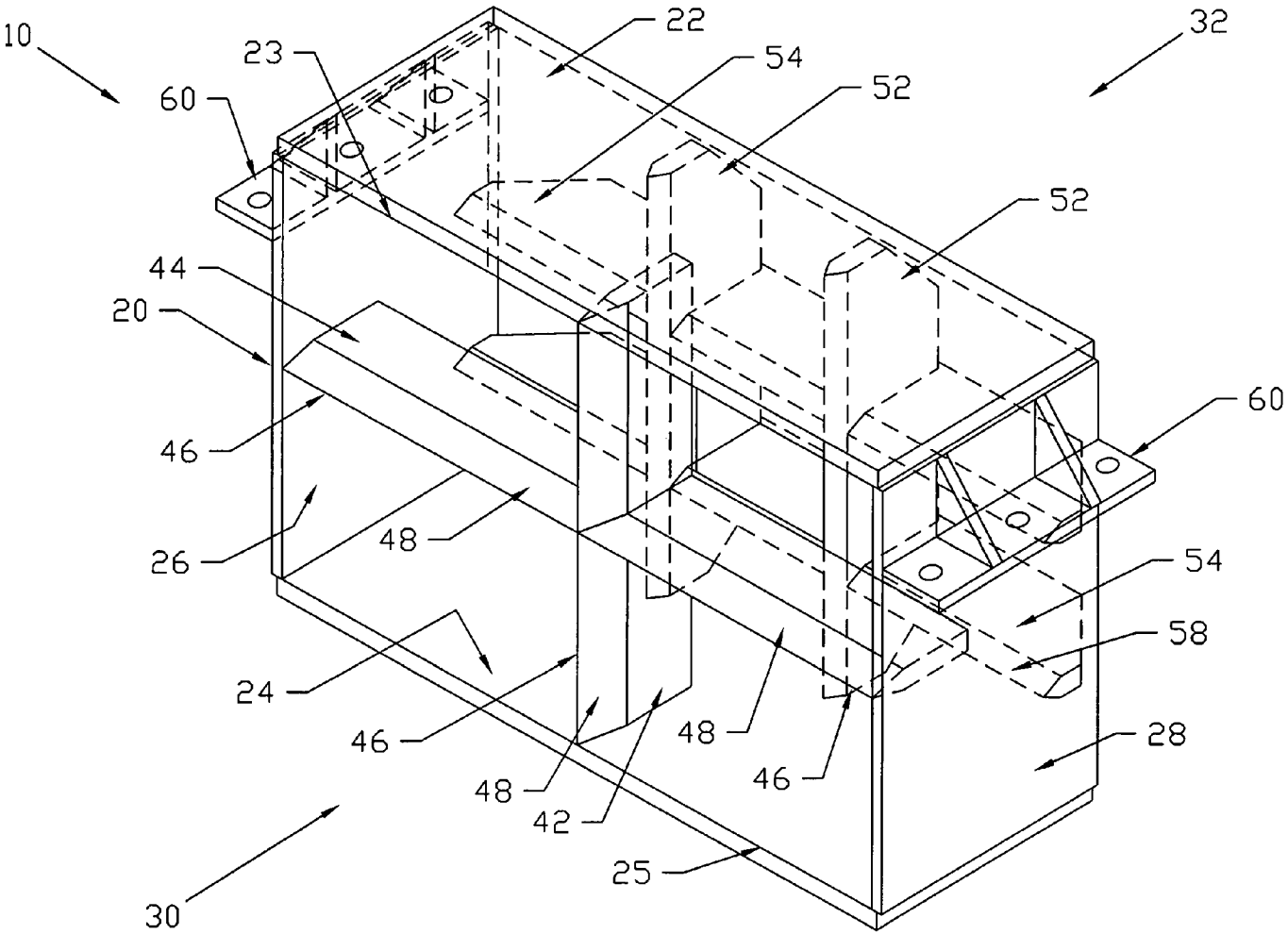
FIG. 1 is an elevational perspective view of one embodiment of the splitter box member of the present invention.
Figure 2:
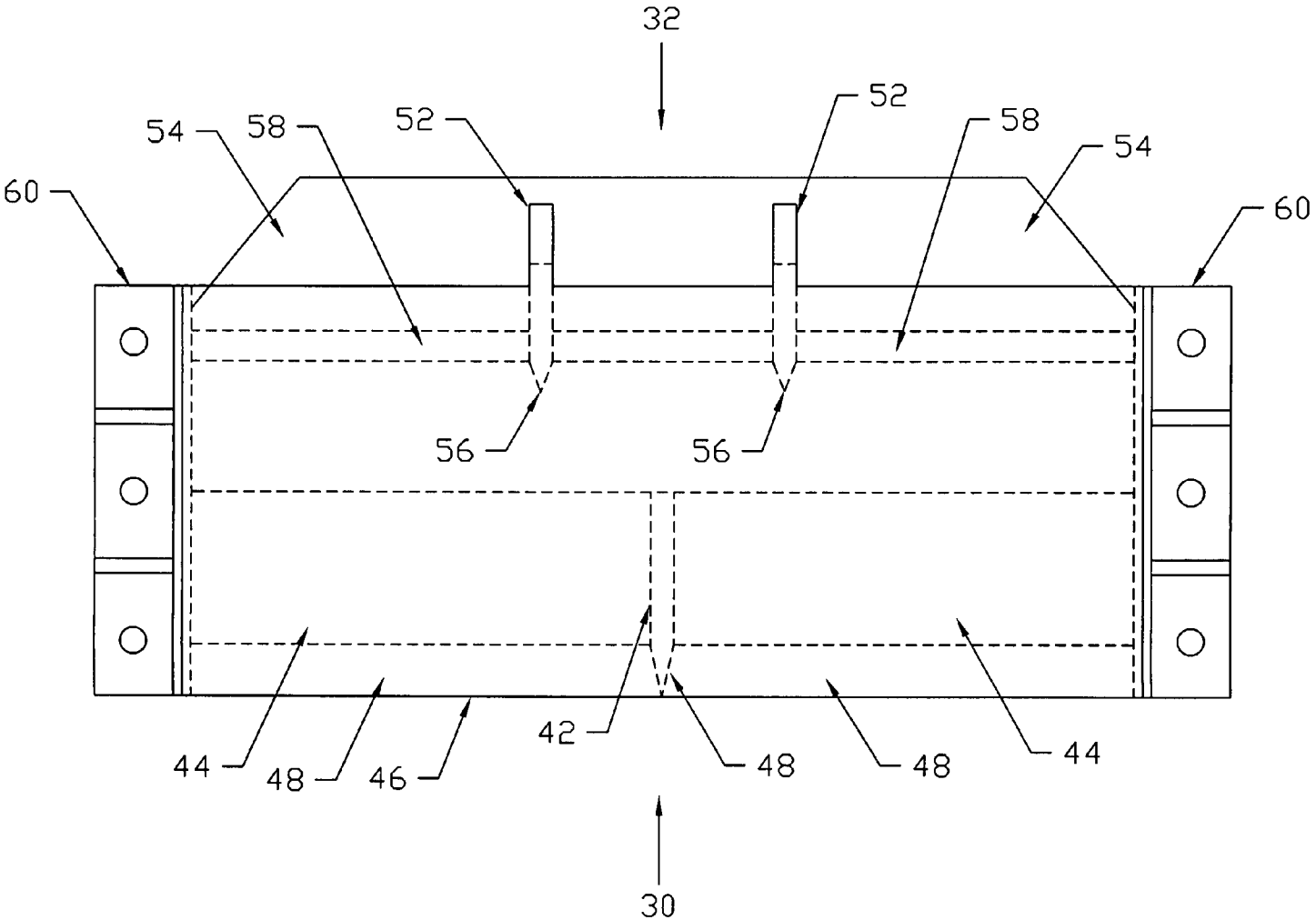
FIG. 2 is a top plan view of the one embodiment of the splitter box member of the present invention.

Nomenclature:

10 Splitter Box Assembly

20 Splitter Box Member

22 Top Wall of Box

23 Sharpened Edge of Top Wall
24 Bottom Wall of Box
25 Sharpened Edge of Bottom Wall
26 Sidewall of Box
28 Sidewall of Box
30 Open Entrance End of Box
32 Open Discharge End of Box
34 Entrance End Section of Splitter Box Member
36 Discharge End Section of Splitter Box Member
38 Fastening Devices Joining Splitter Box Sections
40 First Set of Cutting Blades
42 Primary Vertical Blade Member
44 Primary Horizontal Blade Member
46 Sharpened Edge of Primary Blades
48 Beveled Surface of Primary Blades
50 Second Set of Cutting Blades
52 Secondary Vertical Blade Members
54 Secondary Horizontal Blade Members
56 Sharpened Edge of Secondary Blades
58 Beveled Surface of Secondary Blades
60 Bolt Plate Member
100 Log Splitting System
105 Linear Frame Member
110 First End of Frame Member
115 Second End of Frame Member
120 Hydraulic Ram Assembly
125 Force Applying Surface
130 Primary Hydraulic Cylinder
135 Ram Support Member
140 V-Shaped Log Support Member
145 Open Channel in Log Support Member
150 Surface Portions
155 Secondary Hydraulic Cylinder
160 Bracket for Portions of Force Applying Surface
170 Shroud Covering Hydraulic Cylinders
175 Support Structure for Shroud and Secondary Hydraulic Cylinder Construction:

The invention is a log segment splitting system tat comprises a splitter box member having a top, a bottom, and two sidewalls, an open entrance end and an open discharge end. A first set of cutting blades is secured interior the splitter box member and adjacent the open entrance end thereof. The first set of cutting blades divides the open entrance end of the splitter box member into at least two, first sections. A second set of cutting blades is also secured interior the splitter box member. The second set of cutting blades is offset from the first set of cutting blades and positioned adjacent the open discharge end of the splitter box member. The second set of cutting blades divides each splitter box member first section into at least two, second sections. Each cutting blade of the first and second sets has a cutting edge oriented toward the open entrance end of the splitter box member. A ram assembly includes a force applying surface, moveable toward the open entrance end of the splitter box member, to contact a log segment there between with the first set of cutting blades. The ram member, force applying surface also includes a plurality of surface portions, with each surface portion sized to fit into one splitter box member first section, to further contact the log segment with the second set of cutting blades, thereby splitting the log segment into at least four pieces.

Referring to FIGS. 1–4, several views of one embodiment of the splitter box assembly 10 are shown. The assembly 10 includes a splitter box member 20 that is generally rectangular in shape with a top wall 22, a bottom wall 24 and two sidewalls 26, 28. The splitter box member 20 has an open entrance end 30 and an open discharge end 32. In this embodiment, the entrance end 30 and discharge end 32 are of approximately equal size. Inside the splitter box member 20, a first set of cutting blades 40 is secured to the wall interiors that are adjacent to the open entrance end 30. The first set of cutting blades 40 divide the open entrance end 30 of the splitter box member 20 into at least two, first sections. In the embodiment shown in FIGS. 1–4, the first set of cutting blades 40 includes a primary, vertical blade member 42, and a primary, horizontal blade member 44 in a perpendicular orientation, resulting in four first sections. Preferably, the primary, vertical blade member 42 is positioned on the vertical centerline of the open entrance end 30, and the primary horizontal blade member 44 is positioned on the horizontal centerline of the open entrance end 30 of the splitter box member 20. Each cutting blade member 42, 44 of the first set 40 has a sharpened edge 46, facing the open entrance end 30 of the splitter box member 20, for penetrating an incoming log segment.

Figure 3:
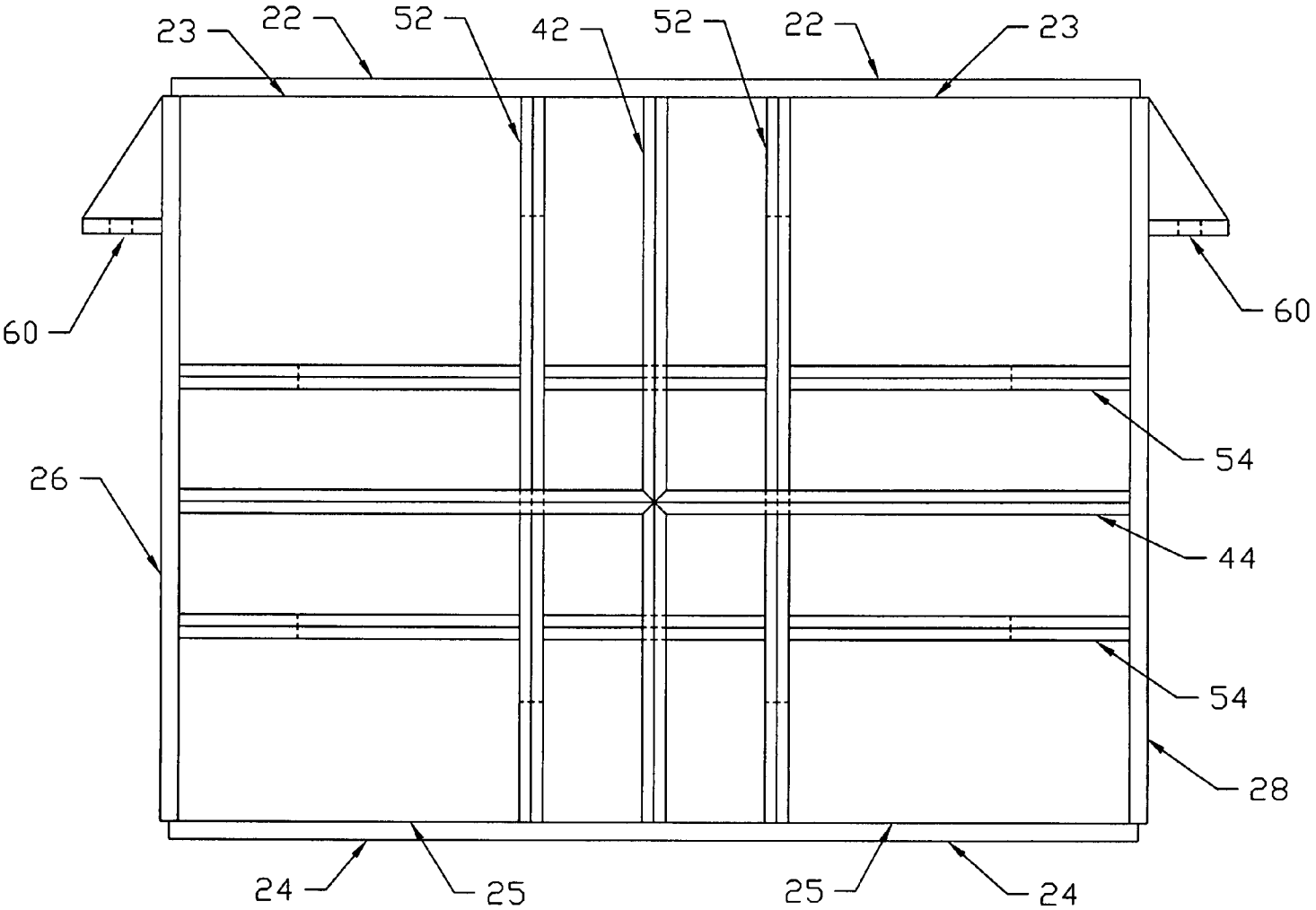
FIG. 3 is a front plan view of the one embodiment of the splitter box member of the present invention.
Figure 4:
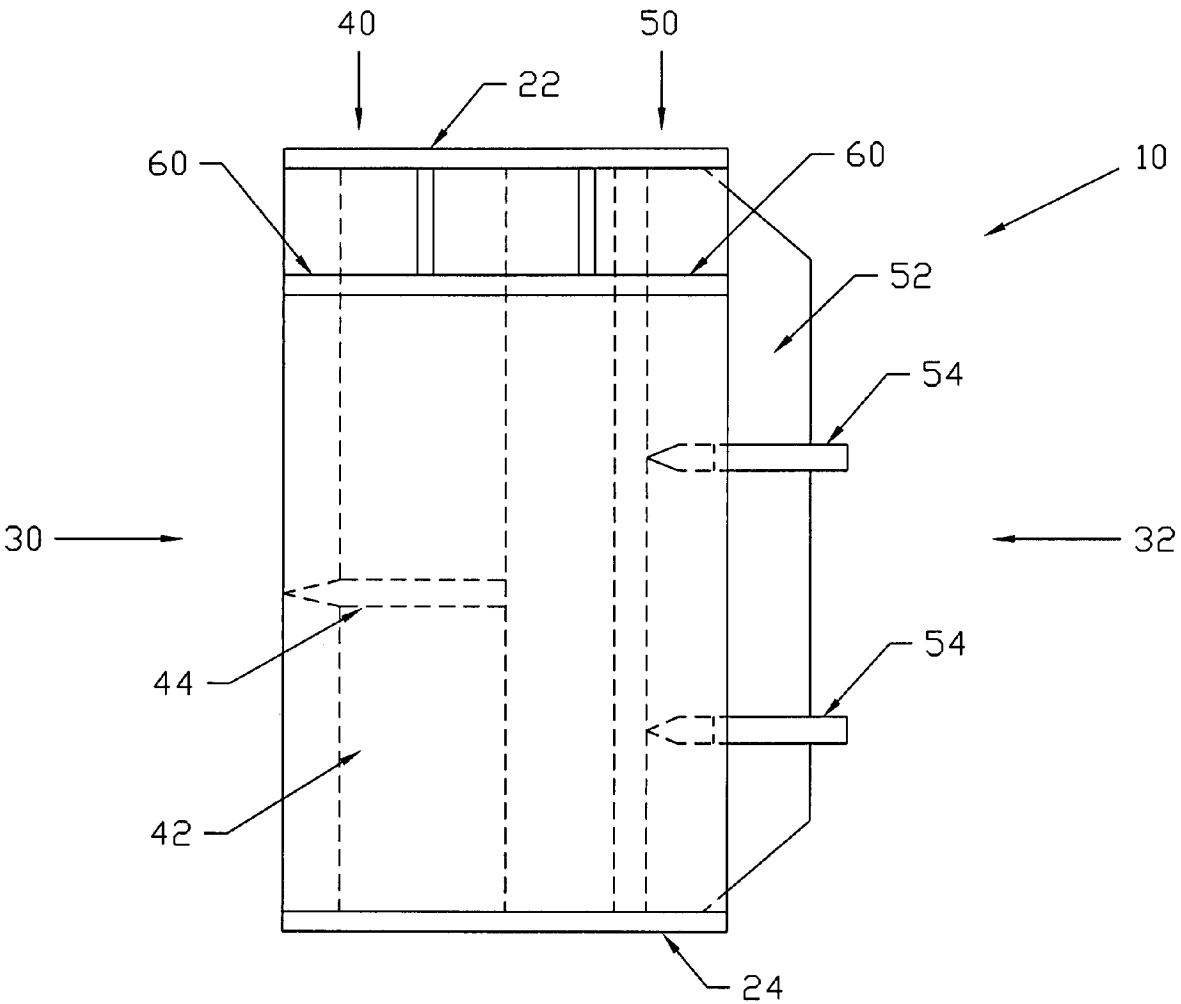
FIG. 4 is a side plan view of the one embodiment of the splitter box member of the present invention.

Interior the splitter box member 20, a second set of cutting blades 50 is secured to the wall interiors, the blades 50 offset from to the first set of cutting blades 40 and adjacent the open discharge end 32. The second set of cutting blades 50 divides each first section of the splitter box member 20 into at least two second sections. In the embodiment shown in FIGS. 1–4, the second set of cutting blades 50 includes a pair of secondary, vertical blade members 52 and a pair of secondary, horizontal blade members 54, with the secondary vertical pair 52 in a perpendicular orientation to the secondary, horizontal pair 54. Thus, each first section is divided into four, second sections, with a total of sixteen, second sections formed, as illustrated in FIG. 3. Each cutting blade 52, 54 of the second set of blades 50 has a sharpened edge 56 facing the open entrance end 30 of the splitter box member 20 for penetrating an incoming log segment. In a preferred embodiment, the splitter box top wall 22 includes a sharpened edge 23 adjacent the open entrance end 30 thereof, and the splitter box bottom wall 24 also includes a sharpened edge 25 adjacent the open entrance end 30 thereof. A bolt plate member 60 is secured to each sidewall 26, 28, exterior of the splitter box member 20 for fastening the splitter box member 20 to a stationary surface, such as the frame member 105, during use.

A log segment, centered on the intersection of the first set of cutting blades 40 and passing through the embodiment of the splitter box member 20 shown in FIGS. 1–4, initially encounters the first set of cutting blades 40 to divide the log segment into four portions, with each portion further divided into four, sub-portions by the second set of cutting blades 50. The first set 40 and second set 50 of cutting blades are positioned so that the splitting of the log segment by the first set of cutting blades 40 is not completed when contact of the log segment with the second set of cutting blades 50 commences.

Figure 5:
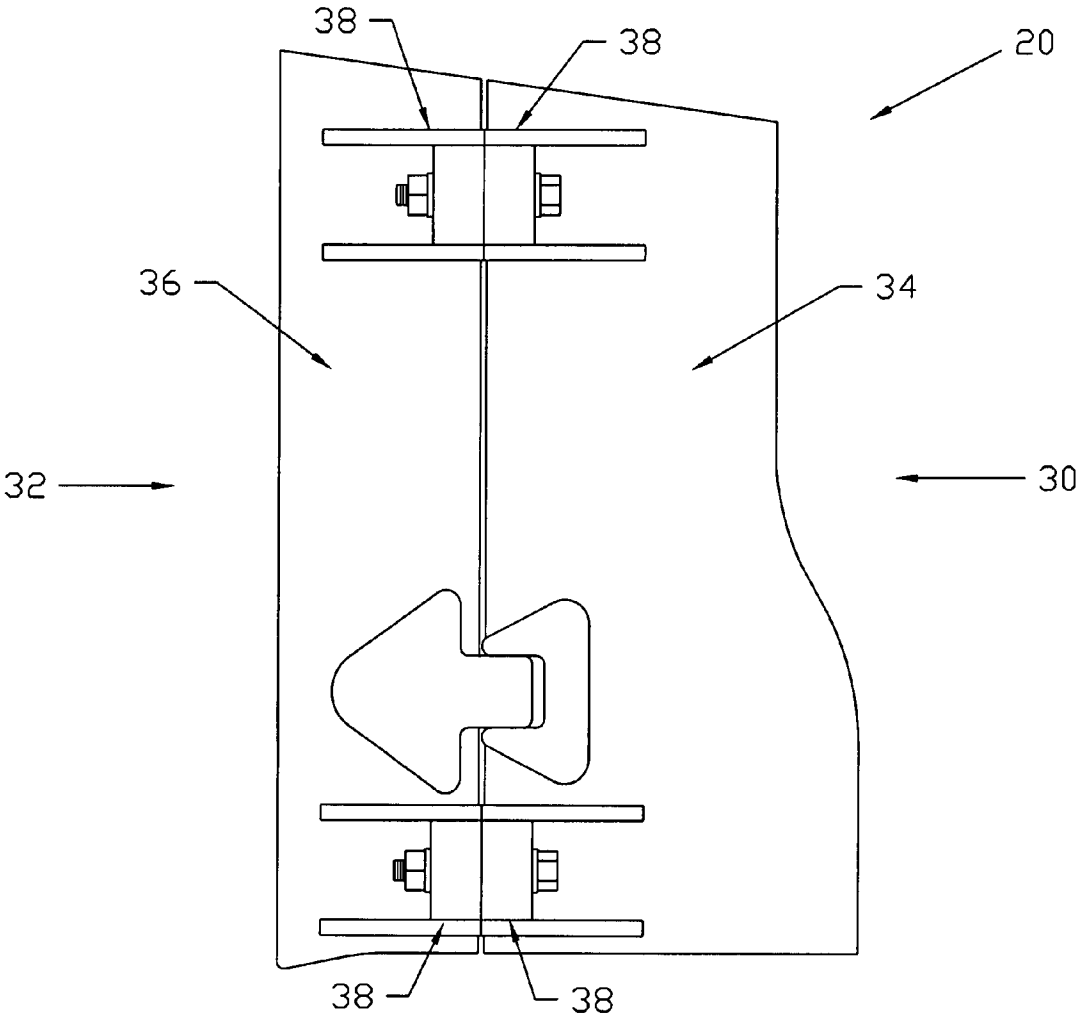
FIG. 5 is an elevational perspective view of a preferred embodiment of the splitter box member of the present invention.
Figure 6:
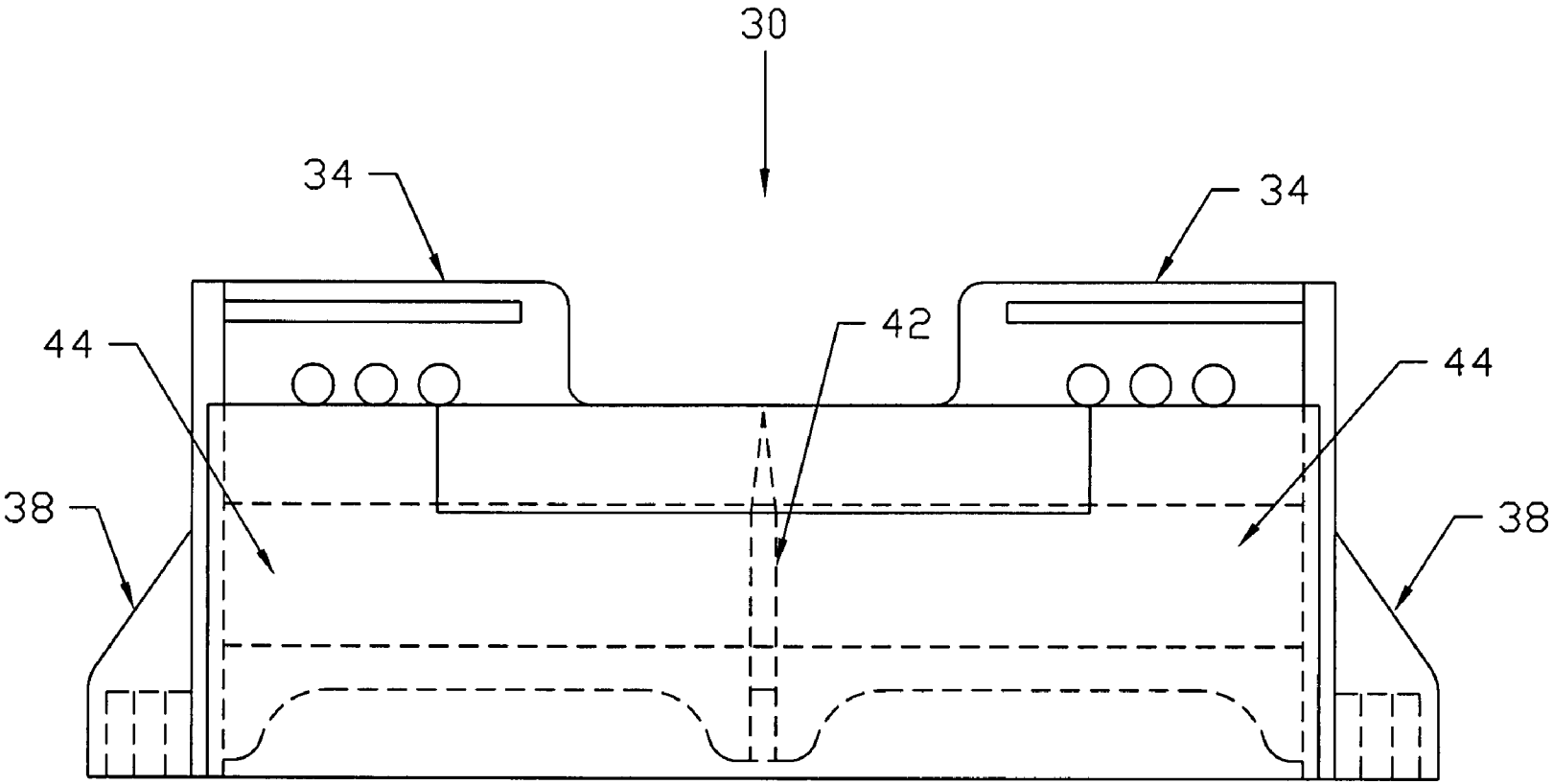
FIG. 6 is a top plan view of the entrance end section of the preferred embodiment of the splitter box member of the present invention.
Figure 7:
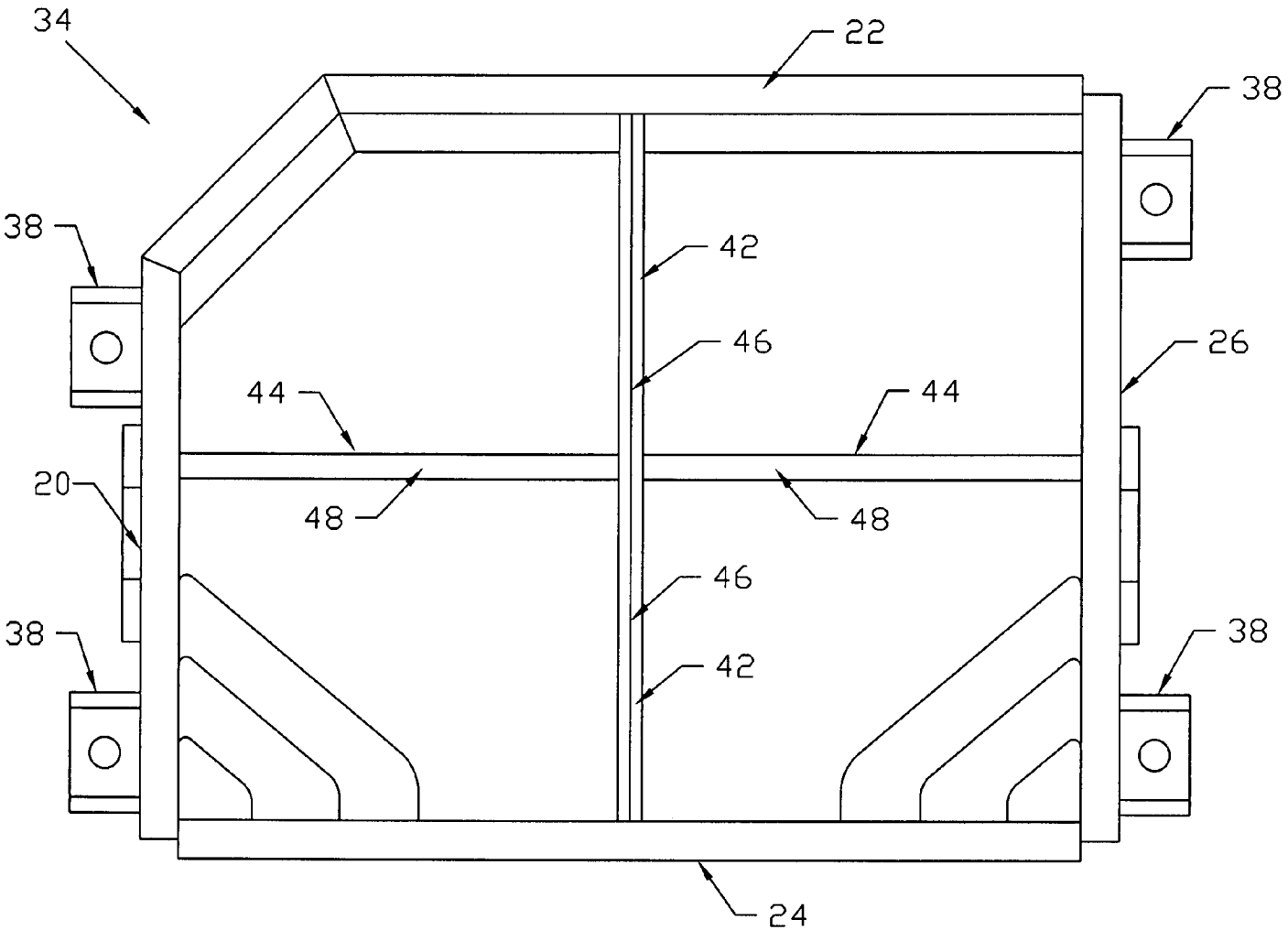
FIG. 7 is a front plan view of the entrance end section of the preferred embodiment of the splitter box member of the present invention.
Figure 8:
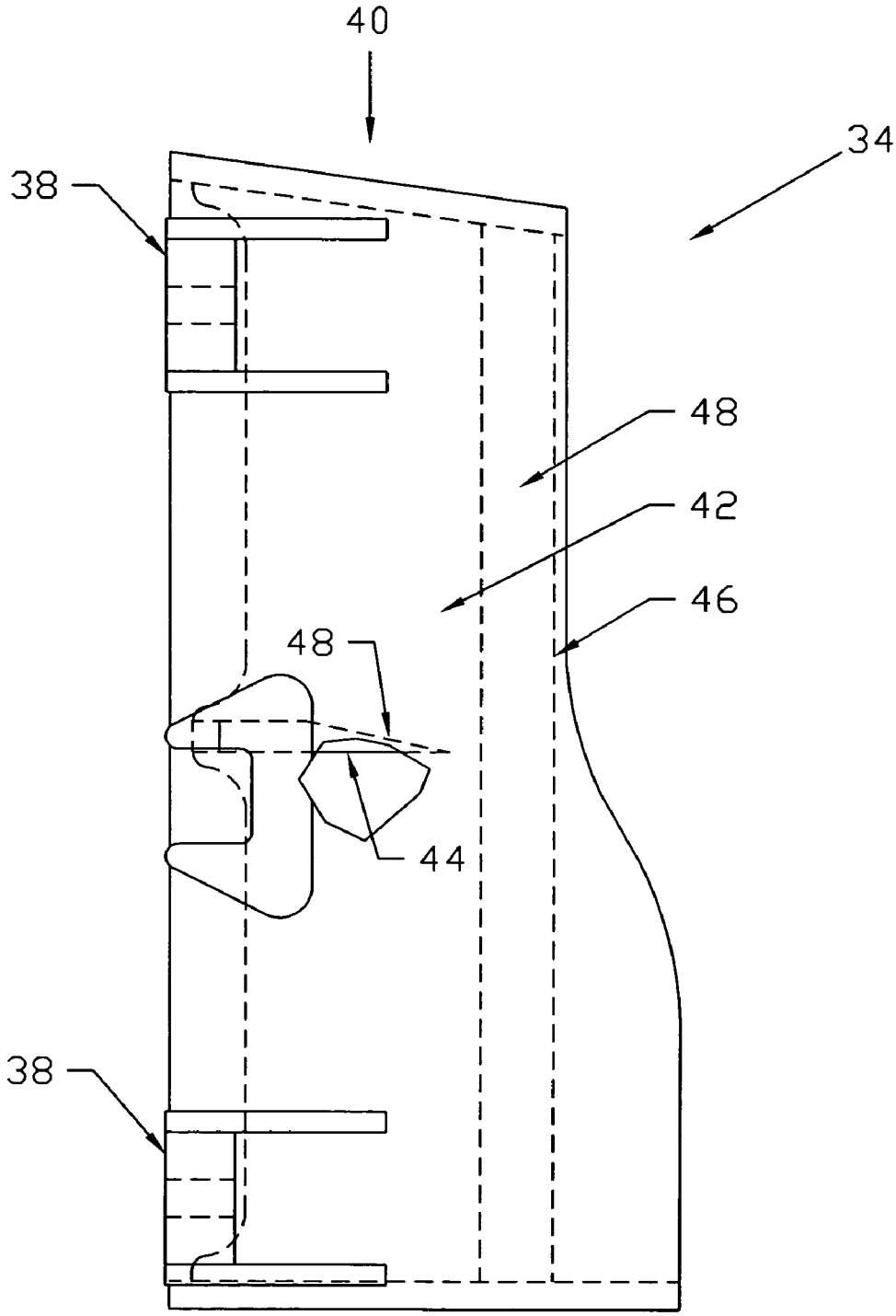
FIG. 8 is a side plan view of the entrance end section of the preferred embodiment of the splitter box member of the present invention.
Figure 9:
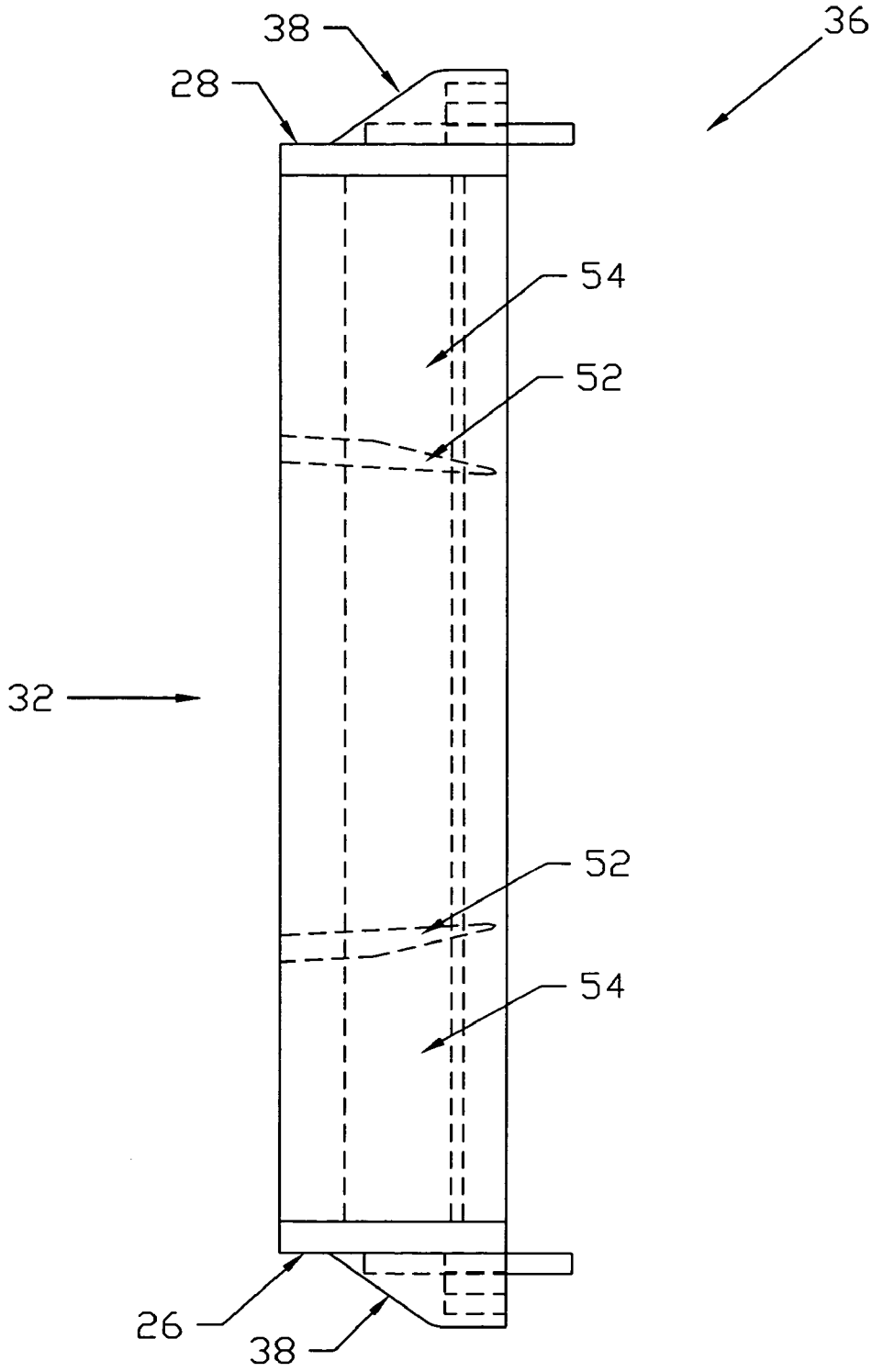
FIG. 9 is a top plan view of the discharge end section of the preferred embodiment of the splitter box member of the present invention.

Referring now to FIGS. 5–11, several views of a preferred embodiment of the splitter box assembly 10 are shown. The assembly 10 includes a splitter box member 20 that is generally rectangular in shape with a top wall 22, a bottom wall 24 and two sidewalls 26,28. The splitter box member 20 has an open entrance end 30 and an open discharge end 32. In this embodiment, the discharge end 32 is larger than the entrance end 30. In this preferred embodiment, the splitter box member 20 comprises an entrance end section 34 and a discharge end section 36, reversibly fastened together in register. Suitable fastening devices 38 provide a rigid connection between the two sections 34,36. For example, the fastening devices 38 may include pairs of brackets with aligned apertures, one bracket of each pair mounted on a splitter box section 34 or 36. The pair of brackets is joined with a threaded fastener, as illustrated in FIG. 5. The feature of two separable sections 34, 36 for the splitter box member 20 provides for ease of manufacture, facile maintenance and clean out, and lower replacement costs should a portion of the splitter box assembly 10 be damaged.

Inside the splitter box member 20, a first set of cutting blades 40 is secured to the wall interiors of the entrance end section 34 that are adjacent to the open entrance end 30. The first set of cutting blades 40 divide the open entrance end 30 of the splitter box member 20 into at least two, first sections. In the embodiment shown in FIGS. 5–11, the first set of cutting blades 40 includes a primary, vertical blade member 42, and a primary, horizontal blade member 44 in a perpendicular orientation, resulting in four first sections. Preferably, the primary, vertical blade member 42 is positioned on the vertical centerline of the open entrance end 30, and the primary horizontal blade member 44 is positioned on the horizontal centerline of the open entrance end 30 of the entrance end section 34 of the splitter box member 20. Most preferably, the cutting edge 46 of the primary horizontal blade member 44 is offset from the cutting edge 46 of the primary, vertical blade member 42. In the embodiment shown in FIGS. 5–11, the cutting edge 46 of the vertical blade member 42 is at the open entrance end 30 while the horizontal blade member 44 is offset toward the discharge end 32. The offset between the blade members 42, 44 could be reversed with equivalent results.

Each cutting blade member 42, 44 of the first set 40 has a sharpened edge 46, facing the open entrance end 30 of the splitter box member 20, for penetrating an incoming log segment. With the offset between the cutting blade members 42,44 of the first set 40, less power is required to advance the log segment into the splitting box assembly 10.

Interior the splitter box member 20, a second set of cutting blades 50 is secured to the wall interiors of the discharge end section 36 that are adjacent to the open discharge end 30. The second set of cutting blades 50 are offset from to the first set of cutting blades 40 and adjacent the open discharge end 32. The second set of cutting blades 50 divides each first section of the splitter box member 20 into at least two second sections. In the embodiment shown in FIGS. 5–11, the second set of cutting blades 50 includes a pair of secondary, vertical blade members 52 and a pair of secondary, horizontal blade members 54, with the secondary vertical pair 52 in a perpendicular orientation to the secondary, horizontal pair 54. The pairs of the second set of cutting blades 50 are positioned such that each first section produced by the first set of cutting blades 40 is intersected by one secondary, vertical blade member 52 and one secondary horizontal blade member 54. Thus, each first section is divided into four, second sections, with a total of sixteen, second sections formed, as illustrated in the Figures.

Each cutting blade 52, 54 of the second set of blades 50 has a sharpened edge 56 facing the open entrance end 30 of the splitter box member 20 for penetrating an incoming log segment. In the preferred embodiment of FIGS. 5–11, the pair of secondary, vertical blade members 52 are inclined toward a vertical centerline of the open entrance end 30 of the splitter box member 20 and the pair of secondary, horizontal blade members 54 are inclined toward a horizontal centerline of the open entrance end 30 of the splitter box member 20. The inclination of the second set of blades 50 assists in separation of the portions of the log segment generated as the log segment passes through the second set of blades 50.

Figure 10:
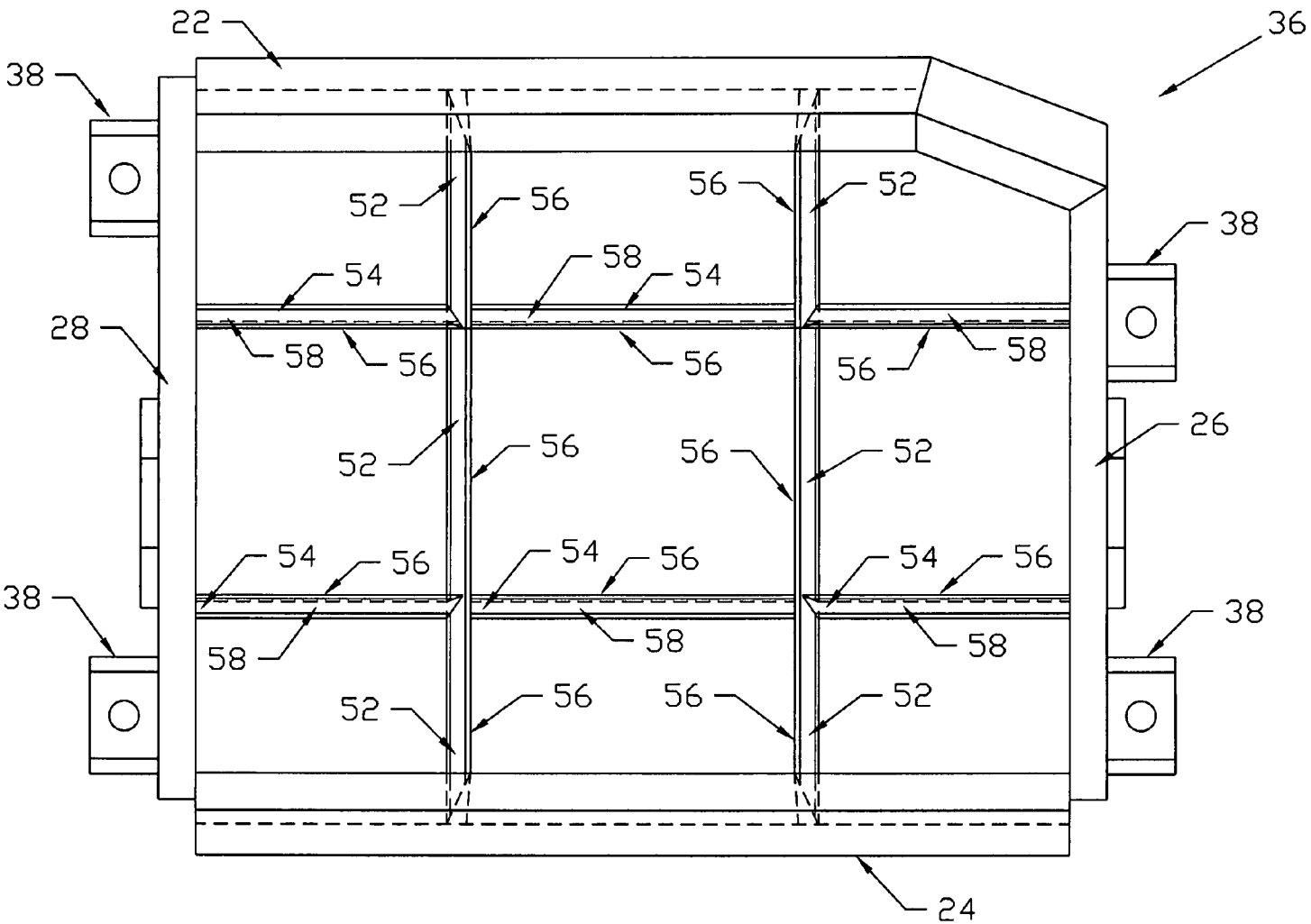
FIG. 10 is a front plan view of the discharge end section of the preferred embodiment of the splitter box member of the present invention.
Figure 11:
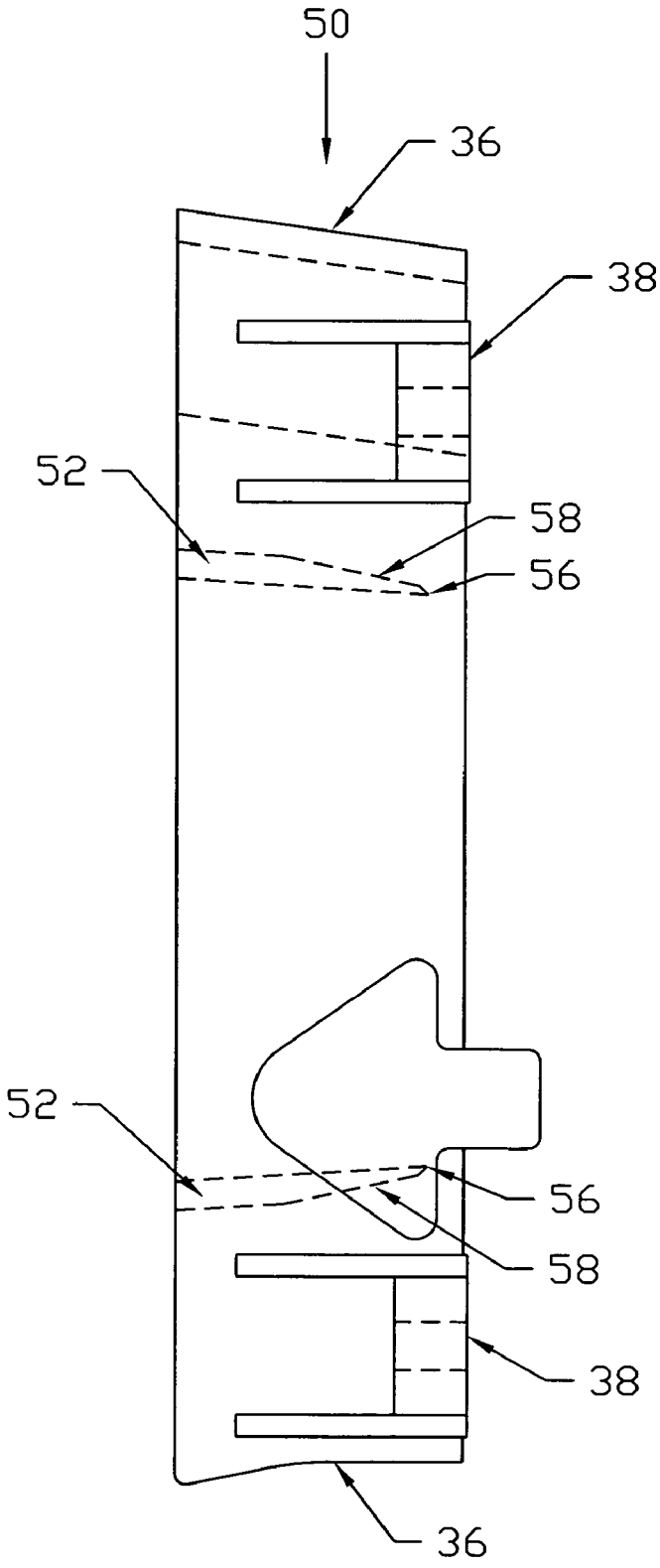
FIG. 11 is a side plan view of the discharge end section of the preferred embodiment of the splitter box member of the present invention.

Also in this preferred embodiment, the cutting edge 56 of the pair of secondary, vertical blade members 52 includes a single beveled surface 58 oriented away from a vertical centerline of the open entrance end 30 of the splitter box member 20 and the cutting edge 56 of the pair of secondary, horizontal blade members 54 includes a single beveled surface 58 oriented away from a horizontal centerline of the open entrance end 30 of the splitter box member 20. The inclination of the blades 52, 54 and the orientation of the blade beveled edges 58 are best seen in FIG. 10. The single bevel of the cutting edge 56 of the second set of blades 50 assists in separation of the portions of the log segment generated as the log segment passes through the second set of blades 50.

Again in this preferred embodiment, the cutting edge 56 of the pair of secondary, vertical blade members 52 are offset relative to the cutting edge 56 of the pair of secondary, horizontal blade members 54.With the offset between the cutting blade members 52, 54 of the first set 50, less power is required to advance the log segment through the splitting box assembly 10.

In a preferred embodiment, the splitter box top wall 22 includes a sharpened edge 23 adjacent the open entrance end 30 thereof, and the splitter box bottom wall 24 also includes a sharpened edge 25 adjacent the open entrance end 30 thereof. In each instance, the sharpened edges 23, 25 are part of the entrance end section 34 of the splitter box member 20.

Figure 12:
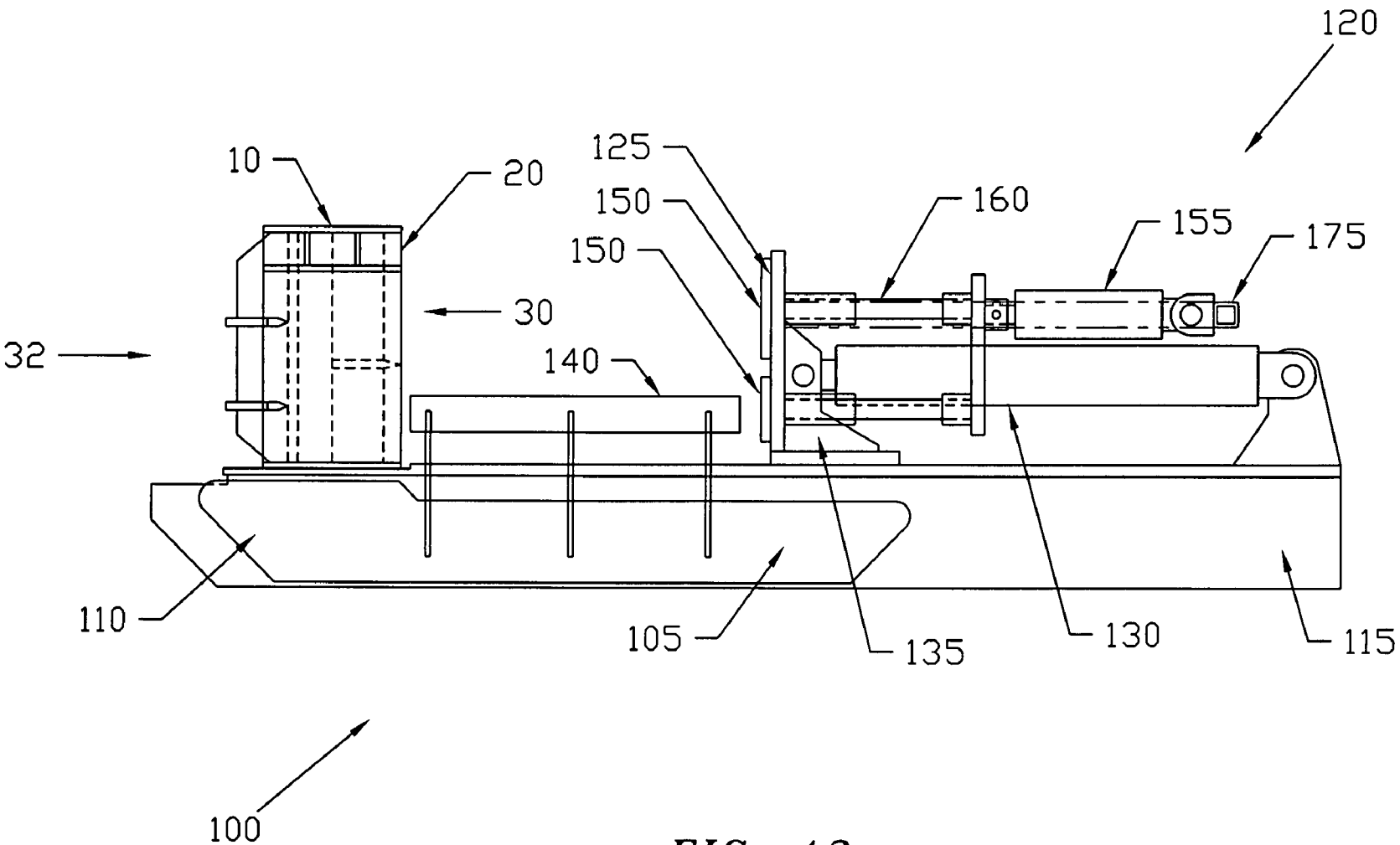
FIG. 12 is an elevational side view of one embodiment of the log segment splitting system of the present invention.
Figure 13:
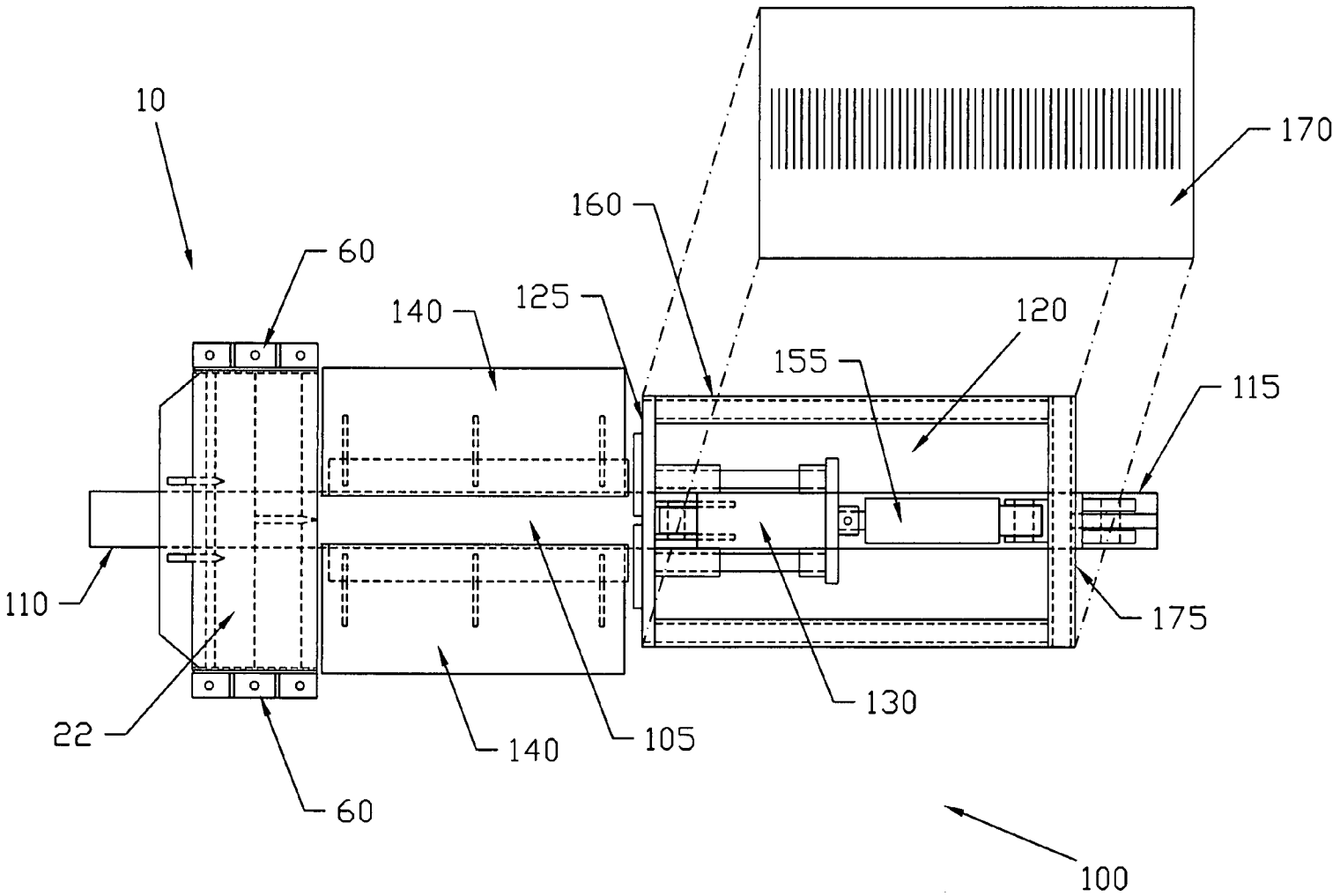
FIG. 13 is a top plan view of the embodiment of the log segment splitting system of FIG. 12 of the present invention.
Figure 14:
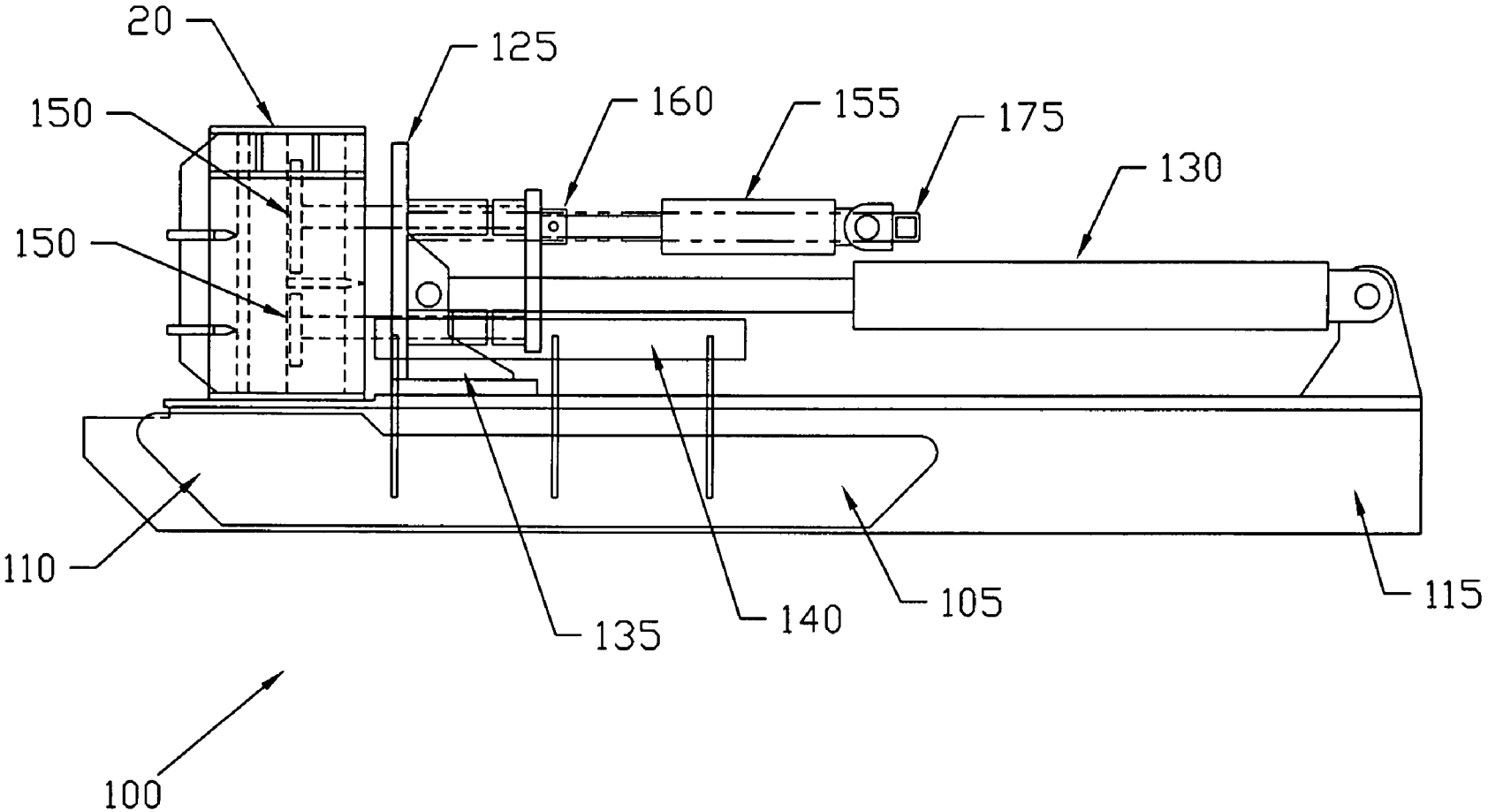
FIG. 14 is another elevational side view of the embodiment of the log segment splitting system of FIG. 12 of the present invention.

Referring now to FIGS. 12–16, one embodiment of the log segment splitting system 100 of the present invention is shown. The splitter box assembly 10 is mounted at a first end 110 of a linear frame member 105, with the open entrance end 30 of the splitter box member 20 facing the rest of the system. At the second end 115 of the frame member 105 is mounted a hydraulic ram assembly 120 for forcing a log segment through the splitter box assembly 10. The ram assembly 120 is anchored to the frame member 105 at the frame member second end 115 opposite the splitter box assembly 10 and the ram assembly 120 moves parallel along the frame member 105. A force applying surface 125 is present on the ram assembly 120 opposite the anchored end, such that extending the primary hydraulic cylinder 130 of the ram assembly 120 moves the force applying surface 125 toward the splitter box assembly 10. The ram assembly 120 also includes a support member 135 that slides along the frame member 105 to support the force applying surface 125 during operation. A V-shaped log segment support member 140 is positioned between the splitter box assembly 10 and the ram assembly 120 to position the log segment for splitting. The log segment support member 140 includes an open channel 145 to accommodate the ram support member 135 as it moves along the frame member 105 in either direction relative to the splitter box assembly 10. The open channel 145 is best seen in the top plan view of the system in FIG. 13. The fully retracted position for the hydraulic ram assembly 120 is shown in FIGS. 12 and 13, while the fully extended position for the hydraulic ram assembly 120 is seen in FIG. 14. A power source (not shown), such as an internal combustion engine, provides the energy to operate the hydraulic cylinders 130, 155 of the ram assembly 120.

Figure 15:
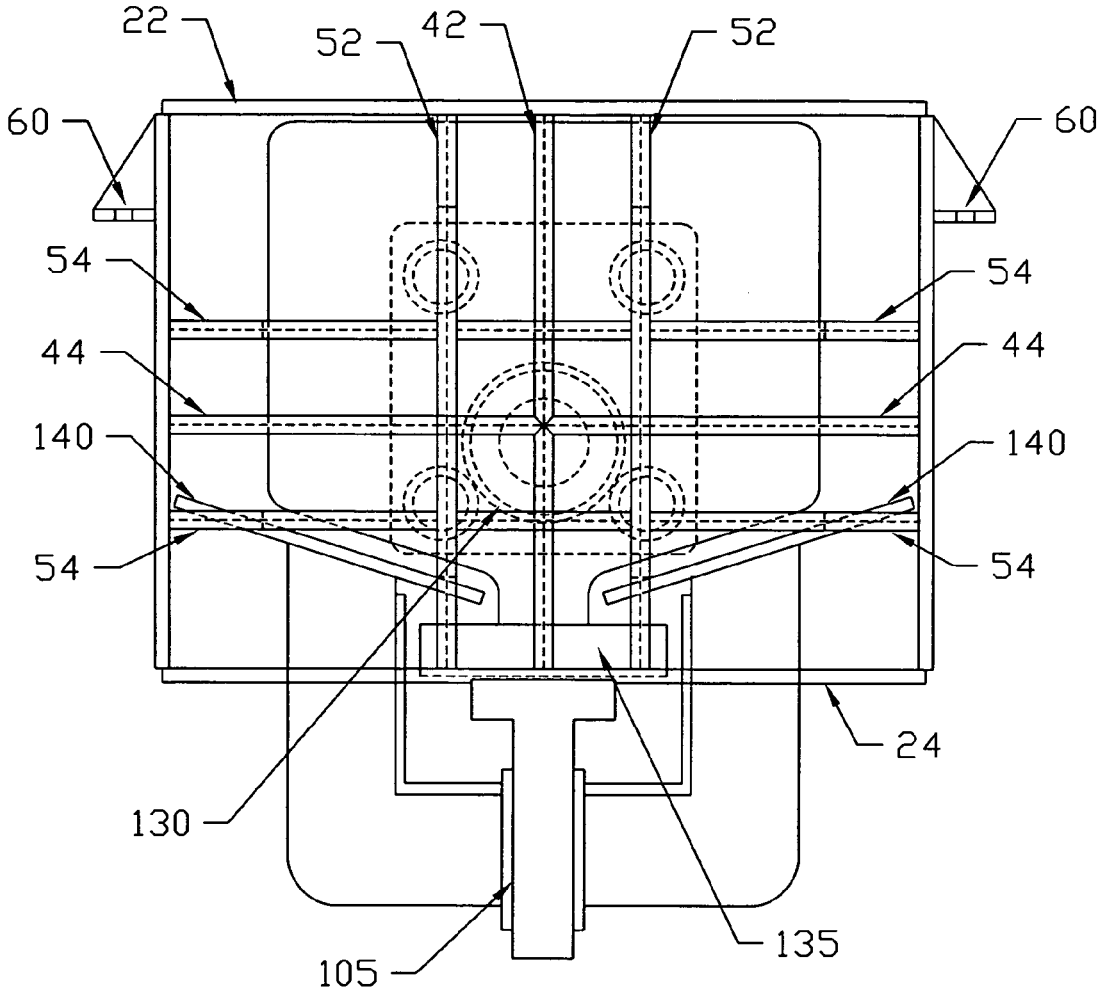
FIG. 15 is an end view from the splitter box assembly open discharge end of the embodiment of the log segment splitting system of FIG. 12 of the present invention.
Figure 16:
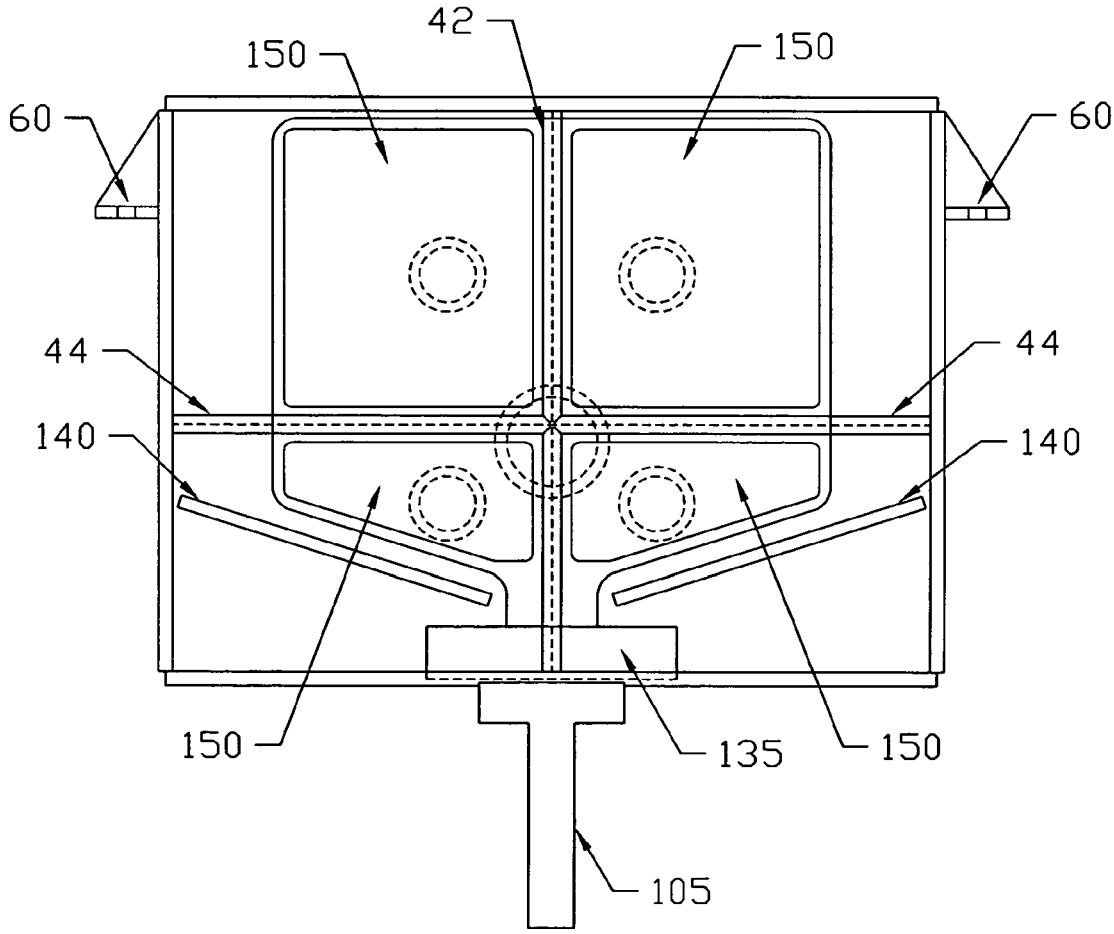
FIG. 16 is an end view from interior the entrance end section of the splitter box assembly of the embodiment of the log segment splitting system of FIG. 12 of the present invention.

The force applying surface 125 of the ram assembly 120 includes a plurality of surface portions 150, with each surface portion 150 sized to fit into one splitter box member first section. The surface portions 150 initially move in unison with the force applying surface 125, via the primary hydraulic cylinder 130, to force the log segment into the first set of cutting blades 40 of the splitter box assembly 10. The support member 135 of the ram assembly 120 stops short of the splitter box assembly 10, as illustrated in FIG. 14. In order to move the unsplit end of the log segment past the first set of cutting blades 40, each surface portion 150 of the force applying surface 125 moves into the splitter box assembly 10, past the first set of cutting blades 40, but stopping short of the second set of cutting blades 50. In the embodiment shown in FIGS. 12–16, the force applying surface.125 includes four surface portions 150 that extend into the splitter box assembly 10, the surface portions 150 powered by at least one, secondary hydraulic cylinder 155 mounted on the primary hydraulic cylinder 130 of the hydraulic ram assembly 120. The surface portions 150 of the ram assembly 120 are best seen in FIG. 16, which is an end view of the log splitting system 100 from interior the splitter box assembly 10, between the first set 40 and second set 50 of cutting blades. An end view of the log splitting system 100 from exterior the splitter box assembly 20 is shown in FIG. 15.

In a preferred embodiment of the invention, the force applying surface 125 is attached to a rigid, heavy duty bracket member 160 housing a single, secondary hydraulic cylinder 155, which is, in turn, mounted to the primary hydraulic cylinder 130 of the hydraulic ram assembly 120. In addition, a shroud member 170 is mounted to the hydraulic ram assembly 120, via the bracket member 160, the shroud member 170 covering the upper sides of the primary 130 and secondary 155 hydraulic cylinders during operation. The shroud member 170 prevents log segments from entering the log support member 140 with the primary 130 and secondary 155 hydraulic cylinders in an extended condition during the operating cycle. A log segment could prevent retraction of one or both hydraulic cylinders 130, 155, causing damage to these components.

A control system (not shown) is employed to run the log splitting system 100 through a cycle that splits one log segment. The sequence is entry of the log segment onto the log support member 140, extension of the primary hydraulic cylinder 130 to bring the force applying surface 125 just to the entrance end 30 of the splitter box assembly 10, extension of the secondary cylinder 155 to bring the surface portions 150 of the force applying surface 125 into the first sections of the splitter box assembly 10, stopping just short of the second set of cutting blades 50, thereby completely splitting the log segment into smaller pieces. The secondary cylinder 155 and the primary hydraulic cylinder 130 retract to the starting position and another log segment enters onto the log support member 140, followed by repeating the above cycle.

It is important to the successful operation of the splitting system 100 that splitting a first log segment by the first set of cutting blades 40 be completed before commencing with splitting a second log segment. Attempting to use the second log segment to force the partially split first segment through the second set of cutting blades 50 often results in several split log pieces wedging within the splitter box second sections or between the blades 40, 50 and the walls 22, 24, 26, 28 of the splitter box 20. The completion of the two-stage splitting process by the travel of each surface portion 150 of the force applying surface 125 into the first sections and up to the second set of cutting blades 50 eliminates plugging and/or wedging of the splitter box assembly 10 by split log pieces.

While the invention has been particularly shown and described with reference to preferred embodiments thereof, it will be understood by those skilled in the art that various changes in form and details may be made therein without departing from the spirit and scope of the invention.

We claim:

1. A splitter box assembly for use in a log segment splitting system comprising;

a splitter box member having a top, a bottom, and two sidewalls, an open entrance end and an open discharge end;

a first set of cutting blades secured interior the splitter box member and adjacent the open entrance end thereof, the first set of cutting blades dividing the open entrance end into at least two, first sections;

a second set of cutting blades secured interior the splitter box member, offset from the first set of cutting blades and adjacent the open discharge end thereof, the second set of cutting blades dividing each splitter box member first section into at least two, second sections;

each cutting blade of the first and second sets having a cutting edge oriented toward the open entrance end of the splitter box member,and the splitter box member including an entrance end section housing the first set of cutting blades and a discharge end section housing the second set of cutting blades, the entrance end section and discharge end section reversibly secured together in register.

2. The splitter box assembly for use in a log segment splitting system of claim 1 wherein, the open discharge end of the splitter box member is larger than the open entrance end of the splitter box member.

3. The splitter box assembly for use in a log segment splitting system of claim 1 wherein, the splitter box member top and bottom each include a sharpened edge adjacent the open entrance end thereof.

4. The splitter box assembly for use in a log segment splitting system of claim 1 wherein, the first set of cutting blades includes a primary, vertical blade member and a primary, horizontal blade member, the cutting edge of the horizontal blade member offset from the cutting edge of the vertical blade member.

5. The splitter box assembly for use in a log segment splitting system of claim 4 wherein, the primary, vertical blade member is positioned on a vertical center line of the open entrance end of the splitter box member and the primary, horizontal blade member is positioned on a horizontal center line of the open entrance end of the splitter box member.

6. The splitter box assembly for use in a log segment splitting system of claim 1 wherein, the second set of cutting blades includes a pair of secondary, vertical blade members and a pair of secondary, horizontal blade members, the second set of cutting blades positioned such that each first section produced by the first set of cutting blades is intersected by one secondary, vertical blade member and one secondary horizontal blade member.

7. The splitter box assembly for use in a log segment splitting system of claim 6 wherein, the pair of secondary, vertical blade members are inclined toward a vertical center line of the open entrance end of the splitter box member and the pair of secondary, horizontal blade members are inclined toward a horizontal center line of the open entrance end of the splitter box member.

8. The splitter box assembly for use in a log segment splitting system of claim 6 wherein, the cutting edges of the pair of secondary, vertical blade members are offset relative to the cutting edge of the pair of secondary, horizontal blade members.

9. The splitter box assembly for use in a log segment splitting system of claim 6 wherein, the cutting edge of the pair of secondary, vertical blade members includes a single beveled surface oriented away from a vertical center line of the open entrance end of the splitter box member and the cutting edge of the pair of secondary, horizontal blade members includes a single beveled surface oriented away from a horizontal center line of the open entrance end of the splitter box member.

10. A splitter box assembly for use in a log segment splitting system comprising;

a splitter box member having a top, a bottom, and two sidewalls, an open entrance end and an open discharge end larger than the open entrance end;

a first set of cutting blades secured interior the splitter box member and adjacent the open entrance end thereof, including a primary, vertical blade member and a primary, horizontal blade member, the cutting edge of the horizontal blade member offset from the cutting edge of the vertical blade member, the first set of cutting blades dividing the open entrance end into four, first sections;

a second set of cutting blades secured interior the splitter box member, offset from the first set of cutting blades and adjacent the open discharge end thereof, the second set of cutting blades including a pair of secondary, vertical blade members and a pair of secondary, horizontal blade members, the second set of cutting blades positioned such that each first section produced by the first set of cutting blades is divided into four, second sections;

each cutting blade of the first and second sets having a cutting edge oriented toward the open entrance end of the splitter box member, and the splitter box member including an entrance end section housing the first set of cutting blades and a discharge end section housing the second set of cutting blades, the entrance end section and discharge end section reversibly secured together in register.

11. The splitter box assembly for use in a log segment splitting system of claim 10 wherein, the splitter box member top and bottom each include a sharpened edge adjacent the open entrance end thereof.

12. The splitter box assembly for use in a log segment splitting system of claim 10 wherein, the cutting edges of the pair of secondary, vertical blade members are offset relative to the cutting edge of the pair of secondary, horizontal blade members.

13. The splitter box assembly for use in a log segment splitting system of claim 10 wherein, the cutting edge of the pair of secondary, vertical blade members includes a single beveled surface oriented away from a vertical center line of the open entrance end of the splitter box member and the cutting edge of the pair of secondary, horizontal blade members includes a single beveled surface oriented away from a horizontal center line of the open entrance end of the splitter box member.

14. A log segment splitting system comprising;

(a) a splitter box assembly including a splitter box member having a top, a bottom, and two sidewalls, an open entrance end and an open discharge end;

a first set of cutting blades secured interior the splitter box member and adjacent the open entrance end thereof, the first set of cutting blades dividing the open entrance end into at least two, first sections;

a second set of cutting blades secured interior the splitter box member, offset from the first set of cutting blades and adjacent the open discharge end thereof, the second set of cutting blades dividing each splitter box member first section into at least two, second sections;

each cutting blade of the first and second sets having a cutting edge oriented toward the open entrance end of the splitter box member;

the splitter box member including an entrance end section housing the first set of cutting blades and a discharge end section housing the second set of cutting blades, the entrance end section and discharge end section reversibly secured together in register; and (b) a ram assembly having a force applying surface moveable toward the open entrance end of the splitter box member to contact a log segment there between with the first set of cutting blades, the ram assembly force applying surface including a plurality of surface portions, each surface portion sized to fit into one splitter box member first section to further contact the log segment with the second set of cutting blades, thereby splitting the log segment into at least four pieces.

15. The log segment splitting system of claim 14 wherein, the ram assembly includes a primary hydraulic cylinder moving the force applying surface toward the open end of the splitter box member and a secondary hydraulic cylinder mounted on the primary hydraulic cylinder moving the surface portions of the force applying surface into the first sections of the splitter box member's open entrance end.

16. The log segment splitting system of claim 14 further including a linear frame member with the splitter box assembly mounted at a first end thereof and the ram assembly mounted at a second end thereof.

17. The log segment splitting system of claim 16 further including a support member fastened adjacent the force applying surface of the ram assembly, the support member sliding along the linear frame member with movement of the farce applying surface.

18. The log segment splitting system of claim 17 further including a V-shaped log segment support member secured to the linear frame member adjacent the open entrance end of the splitter box member, the log segment support member including an open channel accommodating movement of the ram assembly support member there through.

19. A log segment splitting system comprising;

(a) a linear frame member with a splitter box assembly mounted at a first end thereof and a ram assembly mounted at a second end thereof;

(b) the splitter box assembly including a splitter box member having a top, a bottom, and two sidewalls, an open entrance end and an open discharge end;

a first set of cutting blades secured interior the splitter box member and adjacent the open entrance end thereof, the first set of cutting blades dividing the open entrance end into at least two, first sections;

a second set of cutting blades secured interior the splitter box member, offset from the first set of cutting blades and adjacent the open discharge end thereof, the second set of cutting blades dividing each splitter box member first section into at least two, second sections;

each cutting blade of the first and second sets having a cutting edge oriented toward the open entrance end of the splitter box member;

the splitter box member including an entrance end section housing the first set of cutting blades and a discharge end section housing the second set of cutting blades, the entrance end section and discharge end section reversibly secured together in register;

(c) the ram assembly having a force applying surface moveable toward the open entrance end of the splitter box member to contact a log segment there between with the first set of cutting blades, the ram assembly's force applying surface including a plurality of surface portions, each surface portion sized to fit into one splitter box member first section to further contact the log segment with the second set of cutting blades, thereby splitting the log segment into at least four pieces;

the ram assembly including a primary hydraulic cylinder moving the force applying surface and a secondary hydraulic cylinder mounted on the primary hydraulic cylinder moving the surface portions of the force applying surface;

the ram assembly including a support member fastened adjacent the force applying surface thereof, the support member sliding along the linear frame member with movement of the force applying surface; and (d) a V-shaped log segment support member secured to the linear frame member adjacent the open entrance end of the splitter box member, the log segment support member including an open channel accommodating movement of the ram assembly support member there through.

20. The log segment splitting system of claim 19 wherein, the open discharge end of the splitter box member is larger than the open entrance end of the splitter box member.

21. The log segment splitting system of claim 19 wherein, the splitter box member top and bottom each include a sharpened edge adjacent the open entrance end thereof.

22. The log segment splitting system of claim 19 wherein, the first set of cutting blades includes a primary, vertical blade member and a primary, horizontal blade member, the cutting edge of the horizontal blade member offset from the cutting edge of the vertical blade member.

23. The log segment splitting system of claim 19 wherein, the second set of cutting blades includes a pair of secondary, vertical blade members and a pair of secondary, horizontal blade members, the second set of cutting blades positioned such that each first section produced by the first set of cutting blades is intersected by one secondary, vertical blade member and one secondary horizontal blade member.

24. The log segment splitting system of claim 23 wherein, the pair of secondary, vertical blade members is inclined toward a vertical center line of the open entrance end of the splitter box member and the pair of secondary, horizontal blade members are inclined toward a horizontal center line of the open entrance end of the splitter box member.

25. The log segment splitting system of claim 23 wherein, the cutting edges of the pair of secondary, vertical blade members are offset relative to the cutting edge of the pair of secondary, horizontal blade members.

26. The log segment splitting system of claim 23 wherein, the cutting edge of the pair of secondary, vertical blade members includes a single beveled surface oriented away from a vertical center line of the open entrance end of the splitter box member and the cutting edge of the pair of secondary, horizontal blade members includes a single beveled surface oriented away from a horizontal center line of the open entrance end of the splitter box member.

27. The log segment splitting system of claim 19 further including a shroud member secured to the ram assembly, the shroud member positioned to cover from above the primary hydraulic cylinder and the secondary hydraulic cylinder in an extended condition.

* * * * *